US005996486A

United States Patent [19]

Karlyn et al.

[11] Patent Number: 5,996,486

[45] Date of Patent: Dec. 7, 1999

[54] APPARATUS AND METHOD FOR AUTOMATICALLY ADJUSTING THE POSITION OF A SCREEN FRAME IN THE PRINT HEAD OF AN INDEXING SILK SCREEN PRINTING MACHINE IN THE X-AXIS TO MAINTAIN ACCURATE REGISTRATION OF PRINT FROM STATION TO STATION

[75] Inventors: William M. Karlyn, Lynnfield; Michael J. Averill, Salem; Robert J. Duncan, Magnolia, all of Mass.

[73] Assignee: Autoroll Machine Company LLC, Middleton, Mass.

[21] Appl. No.: 08/896,598

[22] Filed: Jul. 18, 1997

[51] Int. Cl.[6] ..... B41F 15/08

[52] U.S. Cl. ..... 101/123; 101/115; 101/129

[58] Field of Search ..... 101/35, 123, 126, 101/127, 129, 115, DIG. 36

[56] References Cited

U.S. PATENT DOCUMENTS

| | | | |
|---|---|---|---|
| 4,750,419 | 6/1988 | Meredith | 101/126 |
| 4,981,074 | 1/1991 | Machita et al. | 101/35 |
| 5,129,155 | 7/1992 | Hoffman et al. | 101/115 |
| 5,158,016 | 10/1992 | Dubuit | 101/123 |
| 5,445,075 | 8/1995 | Panipinto | 101/115 |
| 5,619,919 | 4/1997 | Karlyn et al. | 101/123 |

*Primary Examiner*—Ren Yan
*Attorney, Agent, or Firm*—Herbert Gatewood; Paul J. Cook

[57] ABSTRACT

A method and apparatus for automatically adjusting the location of a screen frame holder of a silk screen printing head in the x-axis to maintain accuracy in registration of color-to-color in a multi-color printing process due to the inaccuracies in indexing of an indexing transport member.

29 Claims, 9 Drawing Sheets

| TOOLING FIXTURE | PRINT HEAD | | | |
|---|---|---|---|---|
| | #2 | #3 | #4 | #5 |
| 1 | +.004 | +.010 | | |
| 2 | +.005 | +.010 | | |
| 3 | +.006 | +.009 | | |
| 4 | +.007 | +.001 | | |
| ••• | | | | |
| 35 | +.002 | -.003 | | |

Fig. 9

APPARATUS AND METHOD FOR AUTOMATICALLY ADJUSTING THE POSITION OF A SCREEN FRAME IN THE PRINT HEAD OF AN INDEXING SILK SCREEN PRINTING MACHINE IN THE X-AXIS TO MAINTAIN ACCURATE REGISTRATION OF PRINT FROM STATION TO STATION

BACKGROUND OF THE INVENTION (1). Field of the Invention

This invention relates, in general, to a silk screen printing machine, and more particularly to a silk screen printing machine comprising an annular-shaped rotatable transport member which is automatically indexed from station-to-station in a multicolor silk screen printing process. Even more specifically, the present invention relates to apparatus for, and a method of, automatically adjusting the position of the screen frame holder, hence the screen frame, mounted to each of the silk screen print heads in a silk-screen printing machine relative to each of a plurality of piece parts located on the transport member to be printed, to maintain accurate print-to-print or color-to-color registration. The present invention particularly relates to a means for, and method of, automatic adjustment of the screen frames mounted to the print heads in the x-axis to increase the accuracy of the print-to-print/color-to-color registration on a compact disc in a multicolor silk screen printing process.

(2). Description of the Prior Art

Flat substrates or piece parts, e.g., compact discs, are commonly printed automatically with graphics by means of a silk screen printing machine comprising, in its basic aspects, an annular-shaped, horizontally disposed, rotatable transport member and a plurality of printing heads located in a plane above the top planar surface of the transport member on a fixed support member. A plurality of tooling fixtures, each for supporting a compact disc for printing, are provided on the top planar surface of the transport member, these being equally spaced apart and defining a like plurality of positions to which the annular-shaped transport member is indexed.

In general, the compact discs are loaded one-at-a-time onto each of the plurality of tooling fixtures, each compact disc being registered in a precise location on the tooling fixture for printing, and vacuum being applied to the bottom of the compact disc to maintain it in the registered position. Once a compact disc is registered on the tooling fixture, the dial then indexes, in turn, to each of the defined positions. At each of the positions where there is located a printing head, the top surface of the compact disc receives a layer of ink in the form of text or graphics.

A silk screen print head basically comprises a squeegee assembly and a silk screen frame holder, the silk screen comprising a screen frame to which is adhesively secured a "silk screen," e.g. a stretched polyester fabric of plain weave. The images or graphics to be printed are provided in an exposed photosensitive emulsion coated on the silk screen in outline form. Thus, at each of the printing stations there is provided a "stencil" having a slightly different outline for the application of the color of ink at that station to the compact discs. The compact discs, on being indexed, must each stop exactly at the position defined by each print head; otherwise, the colors of ink applied to the compact disc surface may be out of acceptable registration with one another.

The dial or annular-shaped rotatable transport member in a silk screen printing machine is commonly one of two types of cam driven indexing systems., i.e., a continuous feed cam or a mechanical cam. A continuous feed cam requires a servo motor drive and very high precision drive components due to the fact that whenever the transport member is indexed the whole drive train is started and stopped.

When a compact disc is loaded onto a tooling fixture, it indexes a multiple number of times before being off-loaded, the number of times that the compact disc is indexed depending upon the number of positions defined by the tooling fixtures provided on the transport member. Thus, where thirty five tooling fixtures, as is now common, are provided on the rotatable transport member, each compact disc is indexed to thirty five positions via, for example, five screen print heads each applying a different color of ink, before being off-loaded. Each time the transport member indexes from one position to another, there can be a small rotational error. To reduce the rotational errors causing misregistration of color-to-color overlay and to provide that the color-to-color overlay is within specification, the rotatable transport member is calibrated. In general, the calibration involves first determining the offset error for each of the thirty five tooling fixtures. Next, a new cam value is determined, i.e., a location for each of the thirty five positions of the cam that provides acceptable registration for each tooling fixture. This is made possible because of the high precision components used and a servo motor drive system linked to an output encoder that has the capability of changing the final stop position of each index. To verify whether the cam now places the compact discs under the print heads at the right location to provide color-to-color overlay within specifications, the above procedure is repeated, i.e., the offsets errors are again determined. The calibration of the rotatable transport member in this manner typically takes several iterations to achieve satisfactory results.

Mechanical indexing type cam driven systems tend to provide good repeatability, i.e., the annular-shaped rotatable dial stops at the same location for a position each time it comes to the same relative position. Thus, for example, tooling fixture #1 will always stop at the same location in the circular-defined path of travel when it is indexed to printing station #1. Nevertheless, the accuracy, i.e., the ability of the dial to stop at equal intervals for each index, may not meet the specifications set for print-to-print/color-to-color overlay. For example, tooling fixture #2, when indexed to printing station #1 may stop at a different location than did tooling fixture #1. The same is true for each of the tooling fixtures located on the transport member being indexed to printing station #1. In other words, the compact discs may not all line up on the x-axis with the position defined by a print head for printing. There is an offset from the location on the x-axis where the compact disc should be for printing relative to the print head caused by the inaccuracies of the indexing system.

Nevertheless, with either a continuous feed cam or indexing cam driven system the best color-to-color registration that can be achieved in a silk screen printing process, e.g., with six color printing is ±0.002". With the silk screen printing industry constantly requiring better color-to-color registration, this degree of registration is not satisfactory.

Thus, there is a real need for automated silk screen printing apparatus comprising an indexing rotatable transport member wherein more accurate color-to-color registration can be maintained in a multicolor printing process.

SUMMARY OF THE INVENTION

A primary object of the present invention is to provide an automated system for the silk screen printing of piece parts not attendant with the problems of the prior art.

Another object of the invention is to provide means for, and a method of, automatically adjusting the silk screen frame mounted to a silk screen print head in the x-axis relative to the location of the center hole of a compact disc prior to the printing of that compact disc.

Another object of the invention is to provide apparatus for, and a method of, maintaining accurate registration of one color-to-another in a multicolor silk screen printing process.

A concomitant object of the invention is to provide apparatus in combination with a silk screen printing machine wherein the specifications for the registration of one color-to-another in a multicolor screen printing process can be better met.

Another object of the invention is to provide apparatus for, and a method of, automatically adjusting the position of the mounting means for a silk screen frame holder mounted to a silk screen print head to maintain accurate registration of print from station to station in an automated indexing piece part silk screen printing machine.

Still another object of the invention is to provide means for, and method of, automatically adjusting for any print-to-print registration errors due to the inaccuracy of the indexing means used for a transport member or dial in a silk screen printing machine for a multicolor printing process for compact discs.

A further object of the invention is to provide means for, and a method of, automatically adjusting for any print-to-print registration offset errors due to the inability of an indexing transport member for transporting flat objects such as compact discs from printing station to printing station to stop at equal intervals on being indexed from station-to-station.

Still another object of the invention is to provide a silk screen printing machine having an indexing type cam drive system wherein accurate color-to-color/print-to-print registration is maintained.

A still further object of the invention is to provide a silk screen printing machine for use in a multicolor screen printing process wherein the transport member or dial is driven by an indexing type cam system and the accuracy in color overlay is ±0.001".

These and other objects and advantages of the invention will become more readily apparent from the detailed description that follows hereinafter, taken in conjunction with the drawings.

BRIEF DESCRIPTION OF THE DRAWINGS

For a better understanding of the present invention and the preferred embodiments thereof, reference should be had to the following detailed description which is to be read in conjunction with the accompanying drawings in which:

FIG. 9 is an example of a chart showing the offset error determinations made for each of the tooling fixtures at each of the print heads.

DETAILED DESCRIPTION OF THE INVENTION AND THE PREFERRED EMBODIMENTS THEREOF

Although the present invention will be described hereinafter with particular reference to the accompanying drawings, it is to be understood at the outset that it is contemplated that the present invention may be varied in specific detail from that illustrated and described herein while still achieving the desirable characteristics and features of the present invention. Thus, the description which follows is intended to be understood as a broad enabling disclosure directed to persons skilled in the applicable arts, and is not to be understood as being restrictive.

The drawings are largely schematized and show only those details and features which are believed necessary for those skilled in the art to understand the invention set forth.

Figure 1:
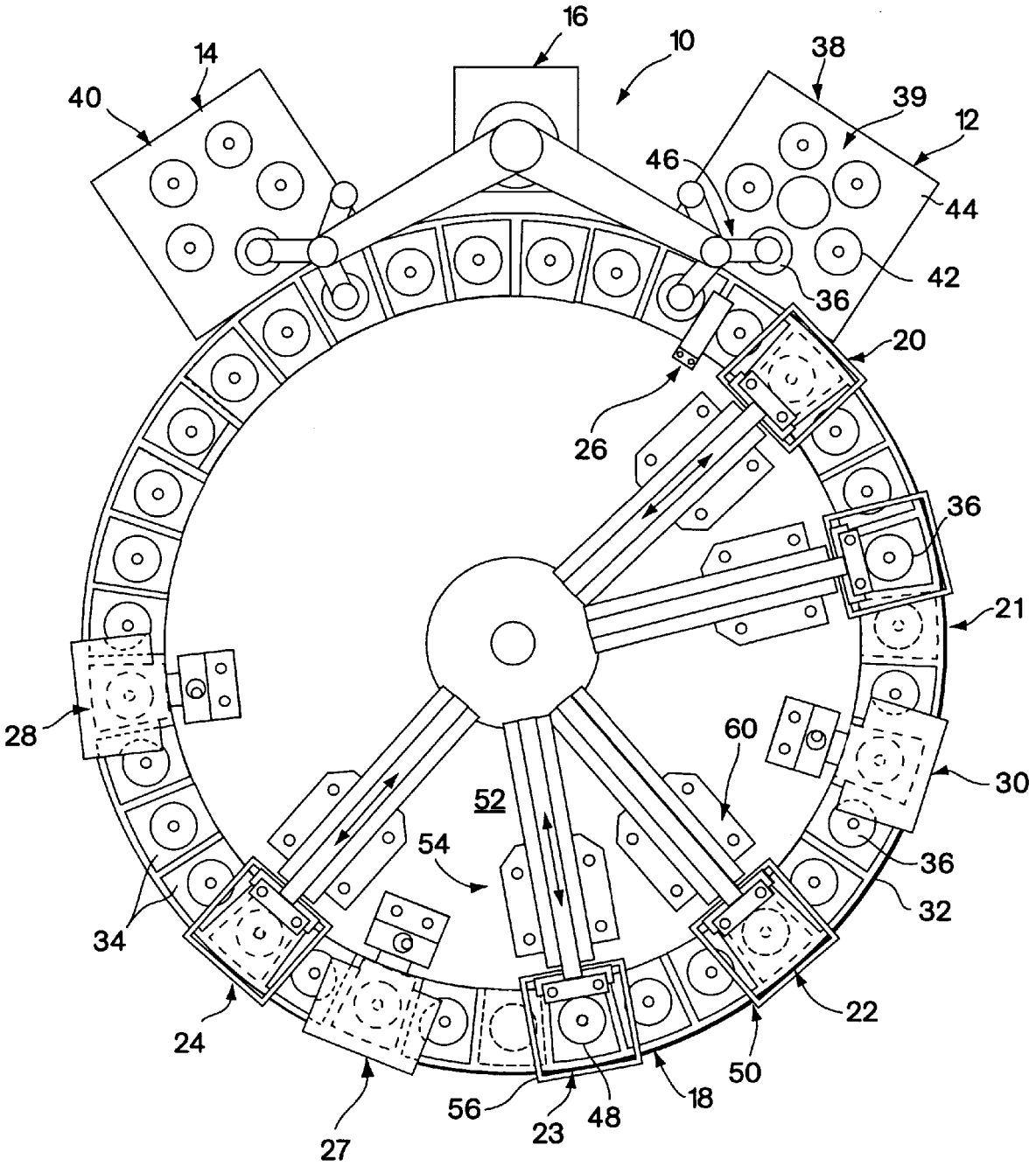
FIG. 1 is a top plan view of an automatic silk screen printing machine according to the invention for the multicolor silk screen process printing of a plurality of compact discs showing the annular-shaped, rotatable transport member or dial, five printing stations, a cleaning station, three UV curing stations, a sending/receiving apparatus, and a loading/unloading apparatus.

Turning now to FIG. 1, there is disclosed a silk screen printing machine 10 for the printing of flat piece parts, e.g., compact discs, comprising, in its basic aspects, sending and receiving apparatus 12, 14, loading/unloading apparatus 16, an annular-shaped, rotatable, indexing, transport member or dial 18 and a plurality of silk screen printing stations denoted by reference numerals 20, 21, 22, 23, and 24. The silk screen printing apparatus also includes conventional cleaning apparatus 26 for cleaning the surface of the compact disc from dust particles prior to being printed with wet ink. Also included are UV-curing stations 27, 28, and 30 such as commonly used in the silk screen printing of compact discs. Although not shown in the drawing, the apparatus can also include conventional inspection equipment located before and after the off-loading point whereby the compact discs are inspected for color registration errors or other defects.

Those skilled in the art of silk screen printing will readily understand that the invention does not depend upon the number of print heads involved in the printing process nor the location of those printers. Although five (5) print heads are shown in the drawing, this is only for purposes of illustration. Typically, a silk screen printing machine may now have six (6) printing stations. Neither does the invention disclosed herein depend upon the location of the cleaning apparatus or the UV-curing stations, as is shown in FIG. 1. This will depend, among other things, upon the number of colors to be put down on, e.g., a compact disc, which printer puts down ink first, the number of compact disc fixtures provided on the transport member, and how many compact disc fixtures are skipped before being printed. A person skilled in the art will readily be able to provide the number of printers, UV-curing stations, etc. and their location, depending upon the particular printing process to be performed.

On the top planar surface 32 of the dial, a plurality of compact disc tooling fixtures, each of which is identified by reference numeral 34, are provided. The compact disc fixtures 34 each supports a compact disc 36 in a well 48 of only slightly larger diameter than that of the compact disc, all as disclosed in U.S. Pat. No. 5,165,340, the complete disclosure of which is incorporated herein by reference. The compact disc is registered in the well of the tooling fixture by a registration pin that is raised vertically upwardly from below the annular-shaped transport member and intrudes into the center hole of the compact disc as it is being loaded. The compact disc is maintained in precise registration for printing by vacuum applied to the bottom surface of the compact disc and is maintained in this precise registration while being transported from the loading point 38 to the off-loading point 40, and from one printing station to another in between.

Thirty five tooling fixtures 34 are shown in the silk screen printing machine disclosed in FIG. 1; however, those skilled in the art will readily realize that this need not be the case for the practice of the invention disclosed herein, later to be fully described. The number of tooling fixtures provided on the annular-shaped transport member can be fewer or greater than 35, as desired. This will depend to some extent upon the number of printing stations to be provided, i.e., the number of different colors of ink to be applied, and the diameter of the annular-shaped transport member.

The sending apparatus 12 shown in FIG. 1 comprises five vertically disposed stacks 42 of compact discs 36, these being radially located on the top planar surface 39 of a conventional indexing table 44. Each of the stacks of compact discs 36 is indexed in turn to the position shown where the topmost disc in the indexed stack is picked up by the arm 46 of the loading/off-loading apparatus 16. The arm 46 then rotates in clockwise manner, being stopped momentarily over a compact disc fixture 34, as shown in FIG. 1. The compact disc is then deposited into the annular-shaped well 48 of the compact disc fixture, vacuum being applied to the bottom surface of the compact disc as it is being loaded into the well. Although the invention disclosed is described more particularly with the use of a disc compact fixture having a well, the compact disc fixture need not necessarily have a well for the practice of the invention. The compact disc fixture may, if desired, be provided with a top planar surface.

At each of the printing stations 20, 21, 22, 23, and 24, there is provided a silk screen printer or print head 50, each being mounted on a stationary support member 52 so as to face radially outwardly, as shown in FIG. 1. The support member 52 is seen to be of circular shape; however, this need not be the case and forms no part of the present invention. The silk screen print heads 50 are identical and only that shown at printing station 20 will be described more fully hereinafter.

The silk screen print head 50 at printing station 20 (FIG. 2) comprises, in general, a screen frame holder 56 and a squeegee assembly 58 mounted to the front end of slide member 60 in usual manner by mounting member 62. At the front end of the mounting member 62, squeegee head 64 is mounted. Depending vertically downwardly from the squeegee head are vertically disposed connecting arms 66 to the bottom ends of which are connected in usual manner a conventional squeegee 68. This connection is not shown in the drawing as such forms no part of the present invention. A conventional screen (not shown) comprising a screen frame and a screen with a pattern of an image thereon to be printed on a compact disc is placed in the screen frame holder on setting up the silk screen printing machine for a printing run.

Figure 2:
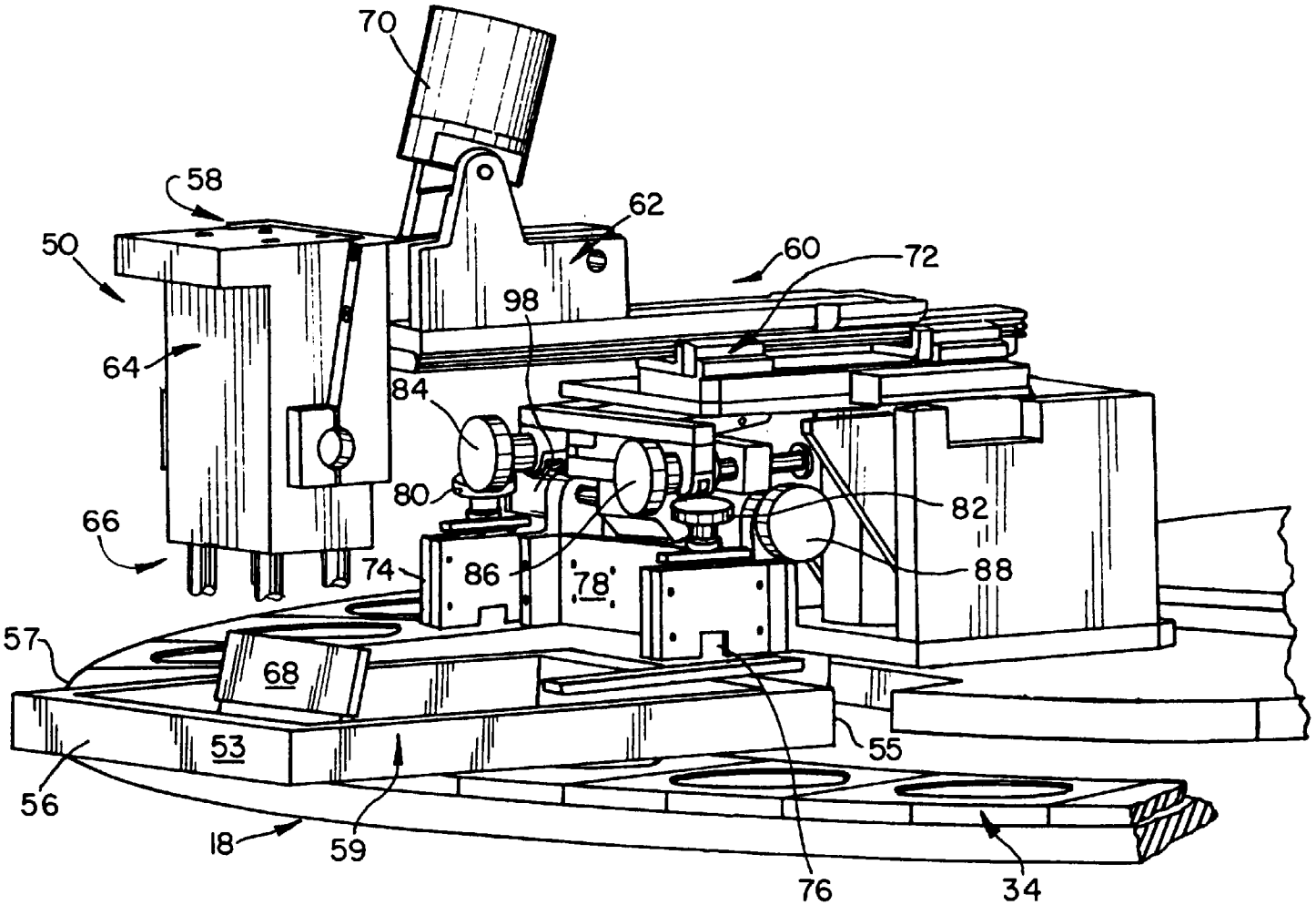
FIG. 2 is a view in partial perspective of the silk screen printing machine shown in FIG. 1 showing the annular-shaped rotatable transport member, the print head at only one of the printing stations and showing the screen frame holder, the means for mounting it to the print head, and the apparatus of the invention that provides movement of the mounting means for the screen frame holder in the x-axis.

The squeegee assembly is further provided with conventional piston means 70 whereby the squeegee head can be pivoted upwardly and downwardly, in usual manner, as desired. The slide member is located in usual fashion in bearing block 72. Thus, the squeegee assembly can move inwardly and outwardly in radial fashion as shown by the arrows in FIG. 1 for the printer shown at printing station 24, during the print cycle. None of the members of the silk screen printing machine above-disclosed and shown in FIGS. 1, 2 are of any particular significance in the practice of the present invention, except as to any specific disclosure made hereinafter.

The screen frame holder 56 is of rectangular shape defined by front and back ends 53, 55 and sides 57, 59. The screen frame holder is mounted at its back end to a screen frame mounting means or assembly, as shown in FIG. 2, which comprises spaced-apart vertically disposed side members 74, 76, and a back member or mounting plate 78. The bottom ends of the vertically disposed side members 74, 76 and the mounting plate 78 are connected to the top surface of the screen frame holder 56 back end in usual manner, although in the drawing, for sake of clarity, they are not shown to be connected together. The manner in which these members are connected together is well known to those skilled in the art and is not believed to require any detailed description herein.

At the top end of the side members 76, 78, there are provided adjustment means comprising rotatable members or knobs 80, 82 whereby the vertical distance between the screen in the screen frame holder and the top surface of the compact disc in the tooling fixture can be adjusted according to usual techniques. Mounted also to the screen frame holder mounting means or assembly are adjustment means comprising rotatable members or knurled knobs 84, 86 and 88 whereby the screen frame holder, and screen located therein, can be adjusted in the x-, y-axes or directions, these axes being based upon the center hole of the compact disc to be printed. Thus, with adjustment members 84, 86, the screen frame holder 56 can be adjusted in the y-direction, i.e., radially inwardly and outwardly from the center point of the annular-shaped transport member 18, relative to the compact disc being printed. With the adjustment member 88 the screen frame holder can be adjusted along the x-axis, relative to the center point of the compact disc tooling fixture, this center point being the 0.0 point of the x-, y-axes. The center point of the tooling fixture is, of course, at the same location as the center of the center hole of the compact disc located in the well of the tooling fixture. Although not shown in the drawing, there is also provided conventional means for adjusting the screen frame holder in the $\phi$ axis.

Figure 3:
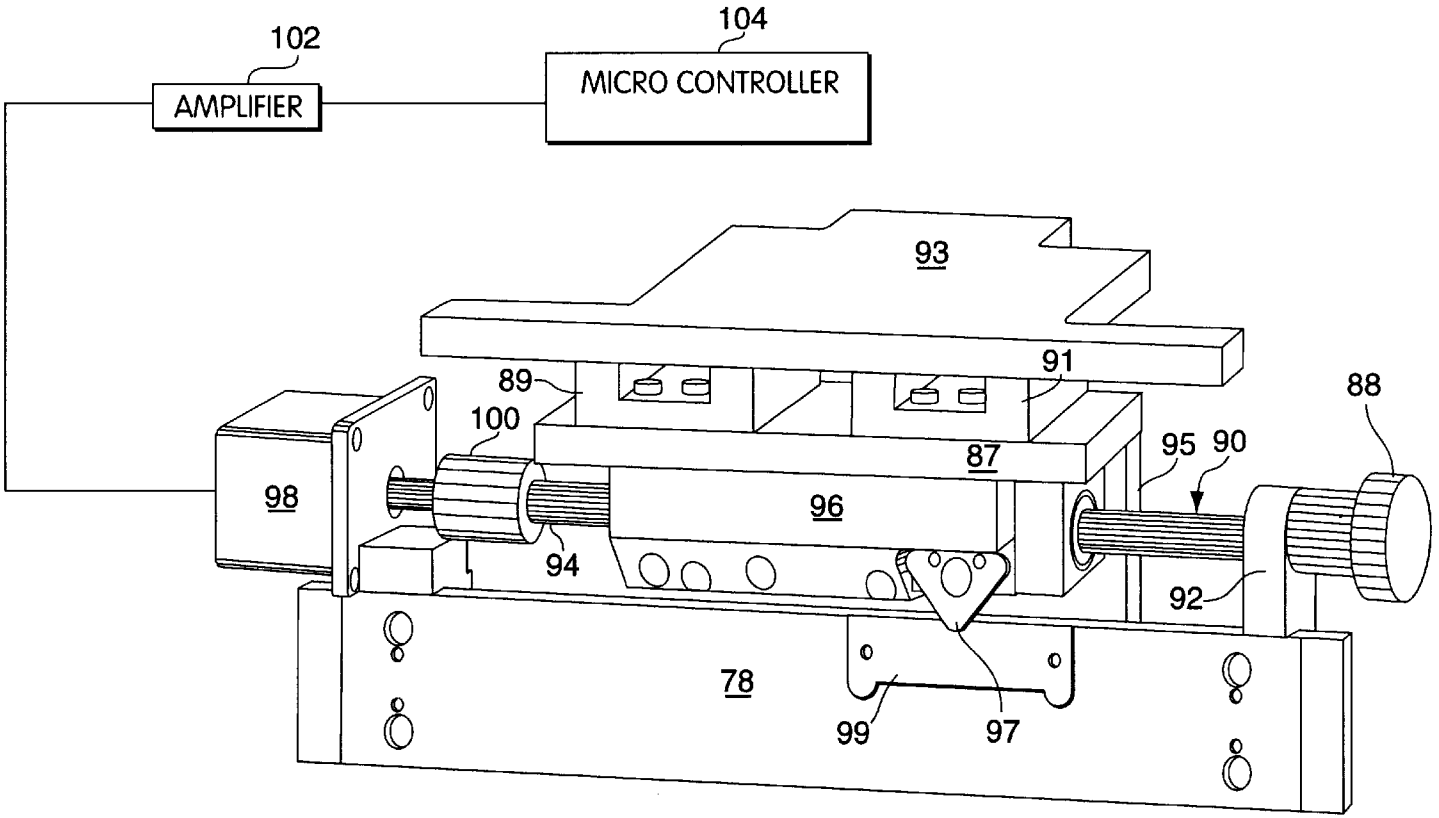
FIG. 3 is an enlarged partial view in perspective showing the mounting means for the screen frame holder and better showing the apparatus of the invention provided in combination therewith for adjusting the location of the screen frame holder mounting means, hence the screen frame/screen in the x-axis, along with the computer controlling the movement of the screen frame holder mounting means, according to the invention.

Turning now to FIG. 3 of the drawing, the critical features of the print head of a silk screen printing machine according to the invention will now be more particularly disclosed. As shown in FIG. 3, the mounting plate 78 of the screen frame holder mounting means is attached at its top end to one end of the elongated screw 90 by means of a collar 92. Although not shown in the drawing, the elongated screw 90 is not provided at its ends with a thread pattern. The end of the elongated screw passes through an opening (not shown) in the collar 92 and is freely rotatable in the collar. Nevertheless, those skilled in the art will readily appreciate that this need not necessarily be the case.

At the end of the elongated screw 90, a knurled knob 88 is fixedly secured thereto in any conventional manner. Accordingly, the turning of the knob 88 with one's hand will cause the screw 90 to rotate in one direction or another. Thus, as will be appreciated more fully later on, knob 88 can be used to mechanically adjust the location of the screen frame holder in the x-axis at time of setting up the silk screen printing machine for a printing run, as is conventionally done.

The elongated screw 90 extends through the elongated, horizontally disposed, body member 96 in an elongated tubular-shaped opening (not shown in the drawing). This opening is provided with an internal thread pattern complementary to the external thread pattern 94 provided on the screw 90. The elongated body member 96 is fixedly attached to the print head, according to conventional manner, by means of horizontally disposed mounting members 87, 89, 91, and 93, and vertically disposed mounting member 95. Thus, when the screw 90 is turned, the screen frame holder 56 (FIG. 2) mounted to member 78 will be caused to move along the x-axis. Those skilled in the art will readily appreciate that a screen placed in the screen frame holder moves along the x-axis to the same extent. As shown in FIG. 3, an indexing means comprising an arrow or marker 97 and a gauge 99 is provided according to usual manner, the marker being attached to the horizontally disposed member 96 and the gauge being provided on the mounting plate 78. Thus, on setting up the screen printing machine for a printing run, the operator will be able to provide the screen frame holder in a predetermined location relative to the x-axis of a tooling fixture.

Those skilled in the art will readily appreciate, it is believed, that the elongated body member 96 can be fixedly attached to the print head other than by the means particularly described above. The main thing is that this body member be fixedly attached to the print head and that the screen frame holder be moveable on the x-axis, as soon will be more fully disclosed.

At the end of screw 90 opposite from the knurled knob 88 there is fixedly connected a conventional stepper motor 98 by means of a coupling 100. Various stepper motors commercially available will be found suitable for the practice of the invention. This will depend somewhat upon the diameter of the screw 90, the thread pattern provided thereon, and the amount of linear movement required. A stepper motor that will be found suitable in the practice of the invention is commercially available from Semix Inc. of Fremont, Calif. under the trade designation RM-24 24S. This stepper motor has the possibility of 1600 steps per revolution. The screw 90 used in the practice of the invention has a pitch diameter of 0.500" and a thread pattern that provides a lead of 0.1" per revolution. Accordingly, causing this stepper motor to rotate by one step will result in the screen frame being moved $6.25^{-5}$ inches in a linear direction.

The stepper motor 98 is connected to a micro controller 104 according to usual techniques via a conventional amplifier 102 for amplifying the signal to the stepper motor. The micro controller 104 is programmed in usual manner to automatically control the various operations and functions of the silk screen printing machine. The micro controller to be used can be any that are commercially available. Although not shown in the drawing, the micro controller is connected to a conventional personal computer, the purpose for which will soon be made clear.

In order to make use of the invention disclosed herein, the silk screen printing machine must first be calibrated, i.e., the offset error of the location along the x-axis of each of the tooling fixtures at each of the silk screen print heads caused by the inaccuracies of the indexing rotatable transport apparatus must first be determined. To do this, a set of calibration screens are first prepared, a master calibration screen for print head #1 and print head calibration screens for each of the other print heads, the nature of which is soon to be fully described. These screens are prepared according to usual techniques for the preparation of a set of screens for printing artwork on a compact disc. In general, a screen is coated with a photopolymer, a film positive is placed on the photopolymer, and the photopolymer is exposed to light. The unexposed areas are washed away leaving the image on the screen in the nature of a "stencil" to be printed.

Figure 4:
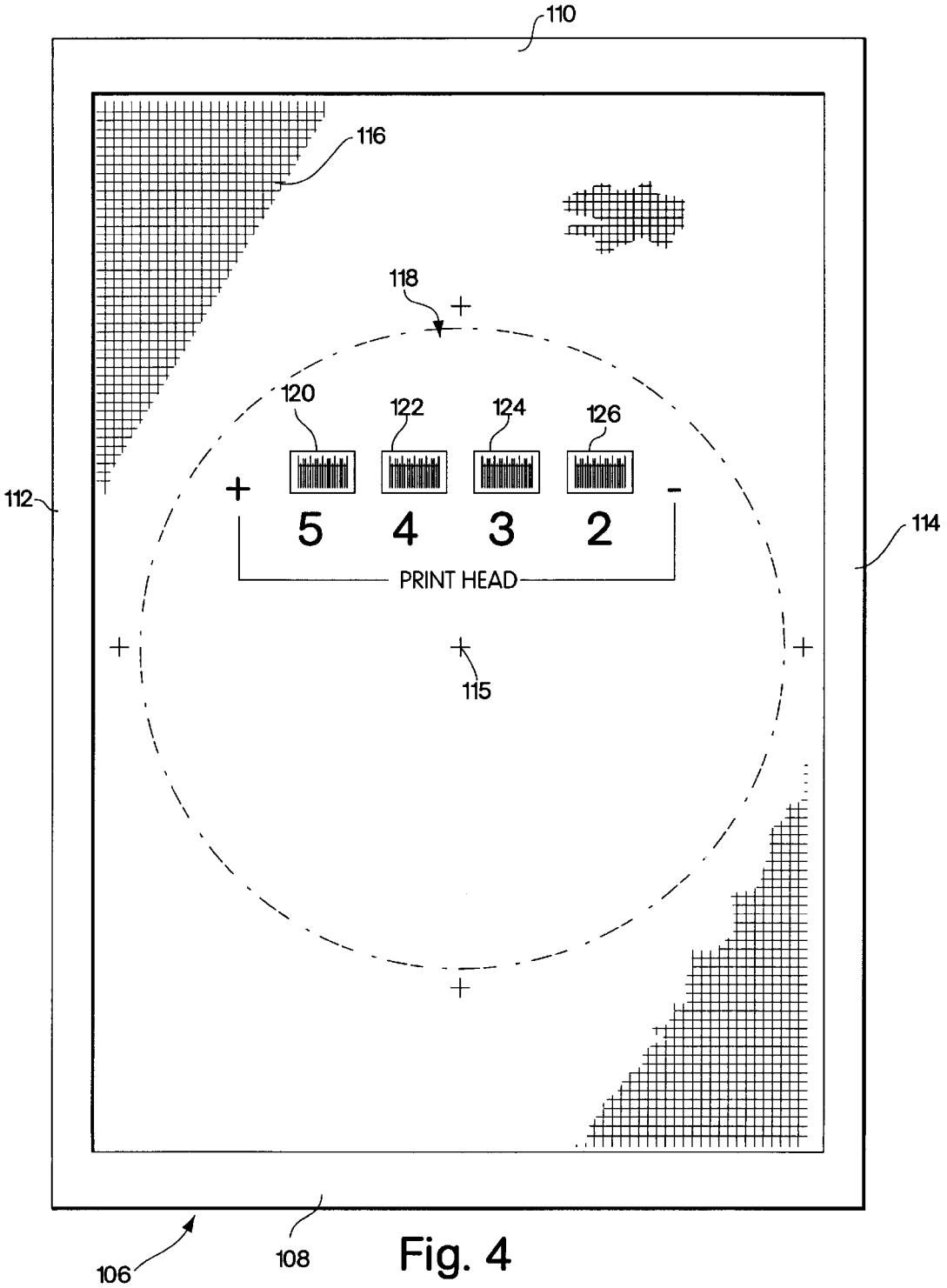
FIG. 4 is a top plan view of a silk screen showing a vernier pattern provided thereon to be placed in print head #1 to provide a master calibration disc, the vernier pattern comprising a row of verniers, one for each of the print heads #2–#5, this vernier pattern being used in determining the offset error in the x-axis of the annular-shaped, rotatable transport member, i.e., the indexer, at each of the print heads.

The master calibration screen 106 is shown in FIG. 4. This screen comprises a typical screen frame defined by parallel front and back ends 108, 110, and parallel sides 112, 114 in perpendicular disposition to the front and back ends, and a screen 116 of a plain weave polyester fabric adhesively secured thereto. The screen is provided with a row 118 of serially aligned verniers 120, 122, 124, and 126, representing print head calibration screens for print heads #2–#5. Those skilled in the art will appreciate that the vernier lines are each, in fact, elongated openings through which ink will be forced in usual manner by a squeegee onto a substrate surface, e.g., a compact disc.

As shown in FIG. 4, the row of verniers defines a line that is parallel to the front and back ends of the screen and the ends of the row of verniers is located equidistantly inwardly from the respective sides 112, 114. The row of verniers is divided by a line that connects the front and back ends of the screen frame and is midway between the sides of the screen frame. This line, as those skilled in the art will appreciate, passes through the center 115 of the center hole of a compact disc represented on the screen by the broken circular pattern. Thus, the row of verniers defines a line that is parallel to the x-axis of a tooling fixture and compact disc located therein. This being the case, any movement of the screen frame will be along that axis. The screen frame holder is, of course, mounted to the screen frame holder mounting means that is adapted to move the screen frame holder along the x-axis.

Although the sequence of the verniers on the master calibration screen is that for print head #5, #4, etc. from the left side 112 of the frame, this is not critical to the practice of the invention. The sequence could be reversed, if desired. Whatever the sequence, the left hand side thereof is indicative of a positive offset error and the right hand side of the vernier row is indicative of a negative offset error. Thus, as will be better appreciated later on, when the offset error of the indexer at a particular print head is positive, the indexer, i.e., the rotatable transport member, has stopped at a position short of where it should have stopped, relative to the fixed location of the print head. Accordingly, the screen frame holder/screen must be moved along the x-axis to the right the same amount as the offset error. The verniers used in the practice of the invention were set up in 0.001" increments; however, this need not be the case. The increments could be less, if desired.

Figure 5:
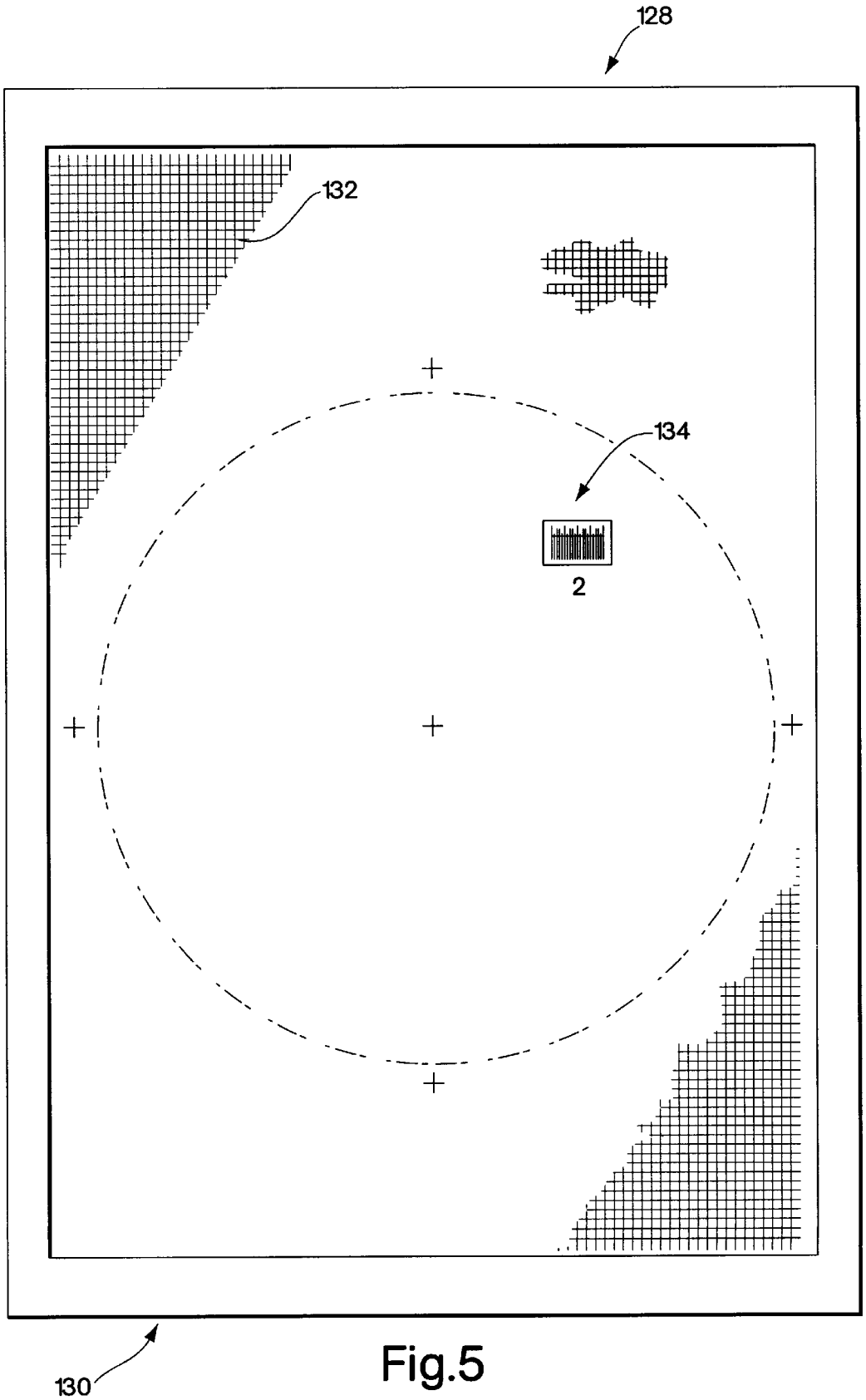
FIG. 5 is a top plan view of a calibration screen for print head #2 showing the vernier to be printed on the compact disc by print head #2 on top of the vernier pattern printed on the compact disc by print head #1.

Turning now to FIG. 5, there is shown therein the calibration screen 128 for print head #2 comprising a screen frame 130 and a screen 132. This print head calibration screen is provided with the vernier 134. Importantly, the location of the vernier 134 for this screen is in the same location on the screen as vernier 126 on the master calibration screen 106, vernier 126 on the master calibration screen being that for print head #2. Nevertheless, in the preferred practice of the invention, the vernier gradation lines in vernier 134 are off-set somewhat in the y-axis, relative to those on the master calibration screen, whereby to provide greater ease in the reading of the verniers.

Figure 6:
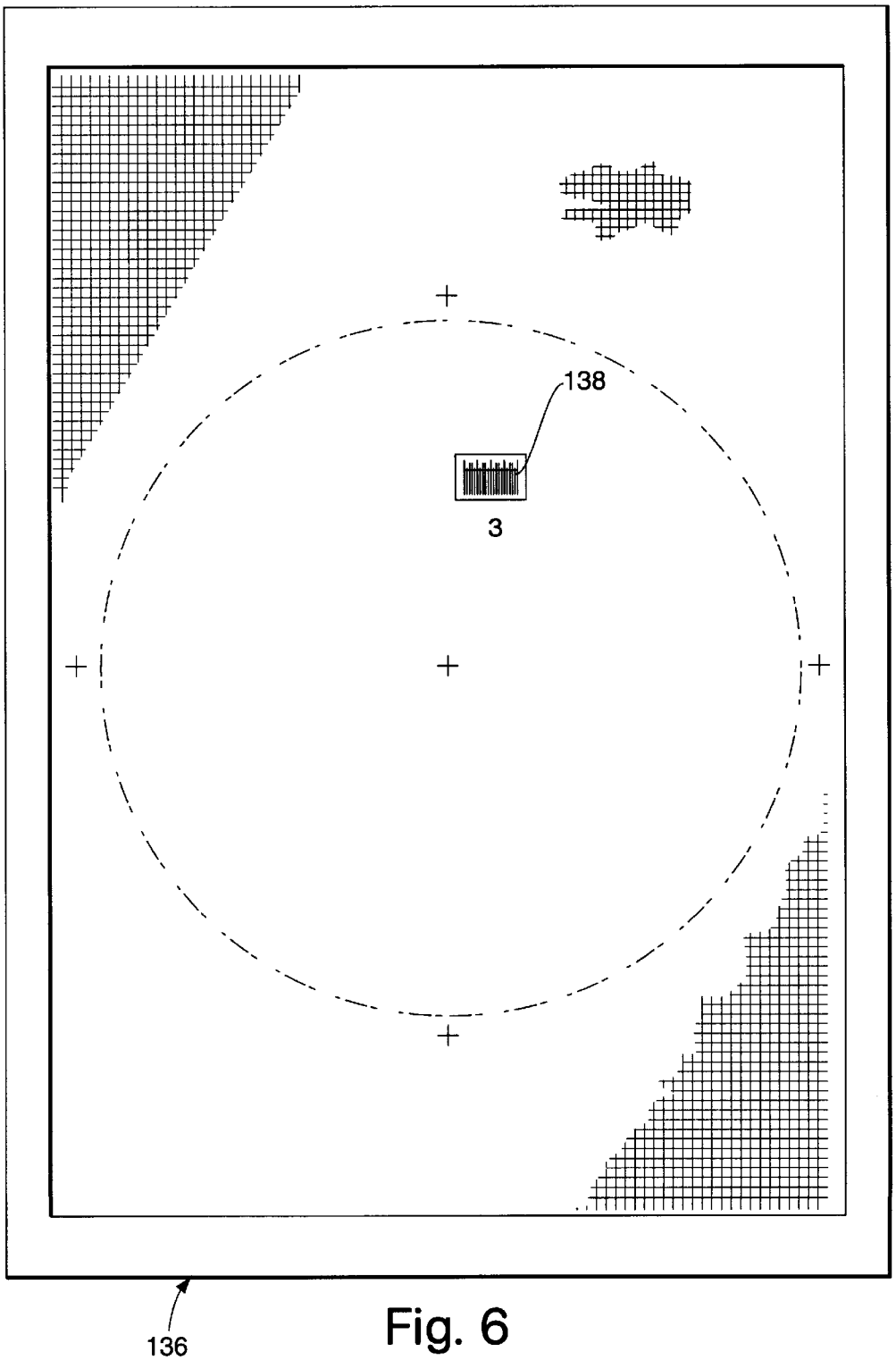
FIG. 6 is a top plan view of a calibration screen for print head #3 showing the vernier to be printed on the compact disc by print head #3 bearing the vernier pattern printed on the compact disc by print head #1.

Print head calibration screens are prepared for each of the other print heads, e.g., calibration screen 136 (FIG. 6) having vernier 138, the verniers being provided on each print head calibration screen being in the same location on that screen as that vernier is on the master calibration screen, except that, as earlier disclosed, the gradation lines of the verniers may be offset somewhat in the y-axis. The master calibration screen is placed in the screen frame holder of print head #1, and the print head calibration screens are placed in the screen frame holders for the respective print heads for a calibration print run, i.e., print head calibration screen 128 is placed in print head #2, the print head calibration screen 136 is placed in print head #3, etc. The silk screen printing machine is then set up in conventional manner for printing by adjusting the location of the screens in the x-y-$\phi$ axes. This is accomplished by turning the appropriate knobs earlier disclosed in the correct direction and to the extent believed necessary to provide the desired registration.

A compact disc is loaded onto tooling fixture #1 provided on the annular-shaped, indexing transport member in usual manner. This can be any tooling fixture on the transport member but it must continue to have that identity. Tooling fixture #2, in the practice of the invention, is the second one following tooling fixture #1 in counter-clockwise fashion. Nevertheless, this need not be the case. Tooling fixture #2 could just as well be the next one to tooling fixture #1 in clockwise fashion. The important thing is that whichever tooling fixture is identified as #2, this identity be maintained. The same is true for all the tooling fixtures identified. Tooling fixture #35 is the one next to tooling fixture #1 clockwise.

Figure 7:
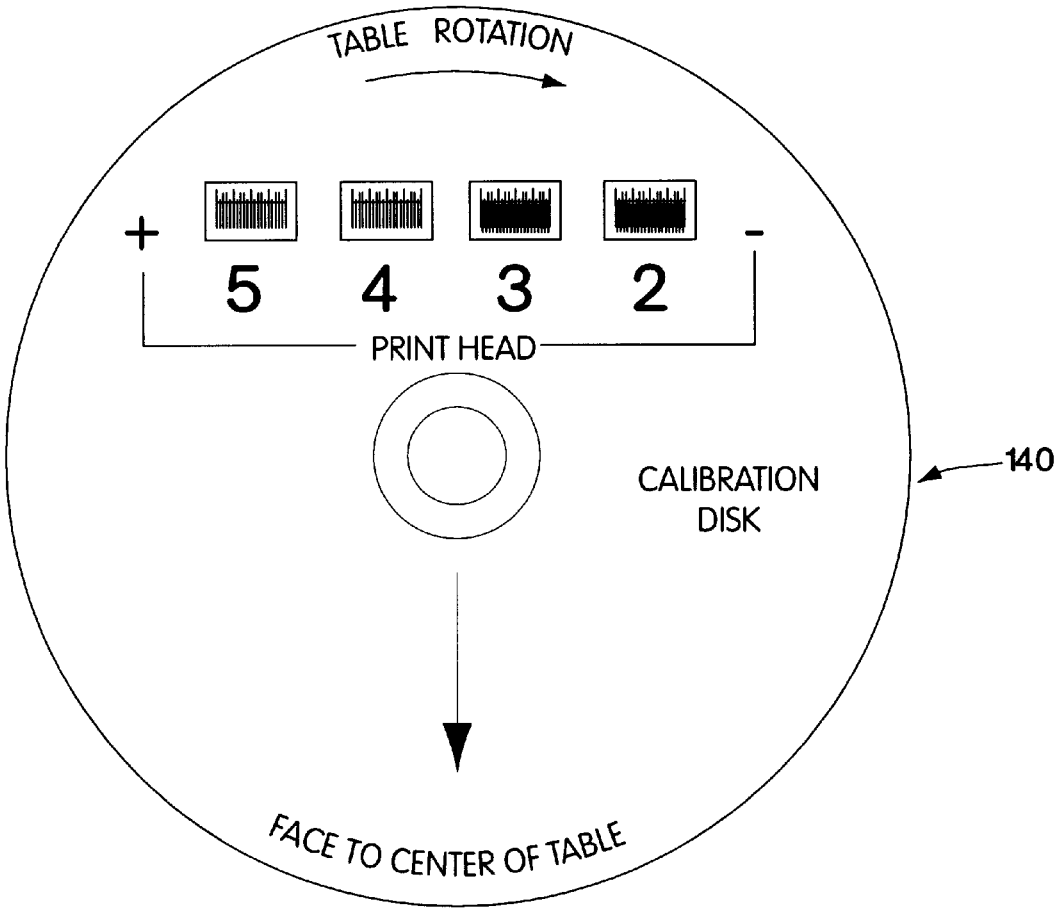
FIG. 7 is a top plan view of a compact disc showing the verniers printed on the compact disc by print heads #2 and #3 over the vernier pattern printed on the compact disc by print head #1, this figure showing an example of the offset error of the indexing transport member at each of the print heads.

Tooling fixture #1 is indexed in usual fashion to silk screen print head #1 where print head #1 prints the vernier pattern of the master calibration screen on the compact disc located in tooling fixture #1 to provide a master calibration compact disc 140 (FIG. 7). Tooling fixture #1 is then indexed to print head #2 where the vernier provided on the screen for print head #2 is printed on the master calibration compact disc overlaying the respective vernier of the master calibration screen vernier pattern printed on the compact disc by print head #1. Since the location of the vernier on print head #2 calibration screen is in the same location as that on the master calibration screen the vernier printed by print head #2 on the master calibration compact disc in tooling fixture #1 will overlay that vernier on the master calibration disc, except for any offset error due to the inaccuracies of the indexing transport member.

Tooling fixture #1 is then indexed, in turn, to the other print heads where a vernier is printed on the compact disc. Thus, when the master calibration compact disc 140 has been printed with a vernier by print heads #2–#5, the compact disc will look like that shown in FIG. 7. In this figure of the drawing, however, only the vernier overlay printed by print heads #2, #3 is shown. The verniers printed on the master calibration compact disc by each of these print heads will overlay the respective verniers printed on the compact disc by the master calibration screen. Then, the offset error for tooling fixture #1 for each of the print heads relative to print head #1 can be determined by reading the verniers in usual manner.

Although the above suggests that the offset errors are determined only after all the verniers have been printed on the master calibration compact disc, this need not be the case. The offset error for print head #2 relative to print head #1 can be determined, if desired, just after the vernier has been printed by print head #2 on the master calibration disc. And, the same procedure can be followed when the verniers are printed on the master calibration disc by each of the print heads.

Tooling fixture #2 is indexed to print head #1 where the compact disc in that tooling fixture is printed with the pattern of verniers provided on the screen in print head #1, as before, to provide a master calibration compact disc. Tooling fixture #2 is then indexed to print head #2 where the vernier on that screen is printed on the master calibration disc. The offset error of the indexer when being indexed to print head #2 relative to print head #1 is then determined by reading the verniers. Tooling fixture #2 is then indexed to print head #3 and the compact disc is printed with that vernier and the amount of the offset error is determined for tooling fixture #2 at print head #3 relative to print head #1 by reading the verniers.

Figure 8:
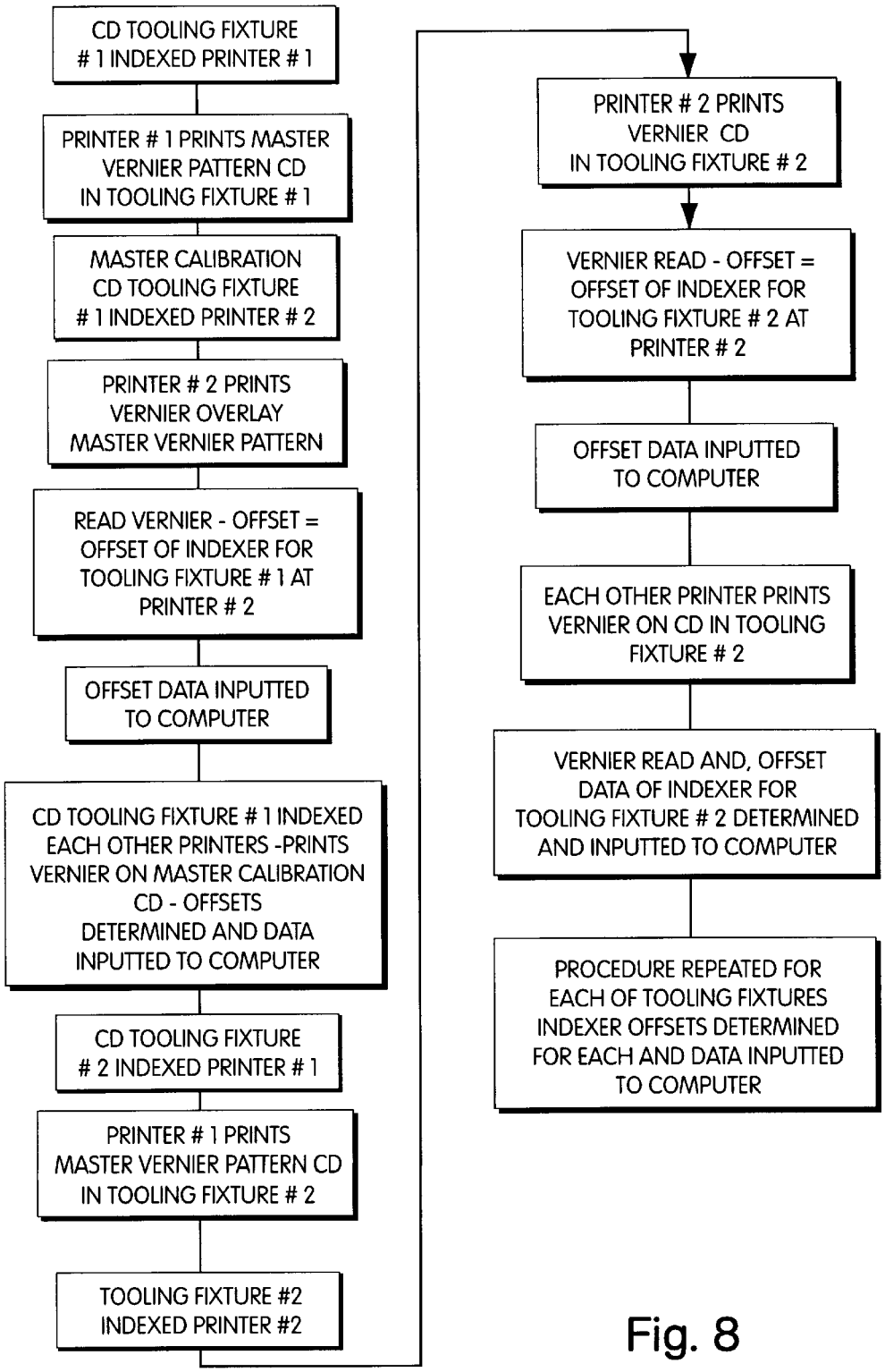
FIG. 8 is a flow chart showing the manner of determining the offset error of the indexer at each of the print heads for each of the tooling fixtures on the annular-shaped rotatable indexing transport member and inputting that information into a computer for later use in providing a signal to a stepper motor to move the screen frame holder mounting means at a particular print head in the x-axis to maintain accurate registration of one color-to-another.

This procedure continues until the offset errors for all the tooling fixtures on the indexing transport member for each of the print heads relative to print head #1 are determined. This procedure is shown in simplified form in the flow chart of FIG. 8. Although the verniers printed on the calibration discs can be of any colors desired, the vernier pattern printed on the master calibration disc should desirably be of a contrasting color to those verniers printed by the other print heads. This will aid in the reading of the verniers. Desirably the vernier pattern on the master calibration disc will be in white ink and those verniers printed by each of the other print heads will be in black.

The offset error determinations are entered into a chart as shown in FIG. 9. There is no offset error determination for any of the tooling fixtures at print head #1. This is the standard against which the offset error determinations for the other print heads are made. Print head #1 puts down the first color on the compact disc; accordingly, this print head presents no problem in the registration of one color to another. The colors put-down by the other print heads cause the problem in registration.

Thus, for example, as shown in FIG. 9, the offset error determined for tooling fixture #1 at print head #2 relative to print head #1 is +0.004 inches. Thus, the transport member has stopped short of the position where it should have stopped for printing. The offset error, as shown in FIG. 9, for that tooling fixture at print head #3 is +0.010 inches. The offset error determined for tooling fixture #2 at print head #2 is +0.005 inches, and that for tooling fixture #3 at print head #2 is +0.006 inches, etc.

Based on the offset errors determined, due to the inaccuracies of the indexing transport member, the screen frame holder at print head #2 must be moved −0.001 on the x-axis to provide tooling fixture #2, when indexed to print head #2, at the same location on the x-axis as tooling fixture #1 when indexed to that print head. And, the screen frame holder at print head #3 must be moved −0.006 to provide tooling fixture #1 at that print head at the correct position on the x-axis for printing.

The offset errors determined, and as set forth in a chart as in FIG. 9, are then manually imputted into a personal computer (not shown), to build a database. This data is then used, according to usual techniques, to program a micro controller or other control means known to those skilled in the art when to send a signal to the stepper motor to rotate the screw and how many rotations to make to cause the screen frame holder to move along the x-axis, in which direction, and how much, to adjust for the offset error due to the inaccuracies of the indexer. Quite advantageously, the signal can be sent to the stepper motor in advance of a particular tooling fixture arriving at a print head and, due to the small movements involved, the movement of the screen frame holder will have occurred prior to the arrival of the tooling fixture at the print head. Those skilled in the art will readily be able to program the micro controller to accomplish this task.

In anticipation of printing a run of compact discs, silk screens are prepared in usual manner, for each of the decorations or color of ink to be applied to the compact discs. The silk screens are each placed in their respective print heads after which the print heads are set up for printing in usual manner. Thus, the machine operator manually adjusts the location of the screen frame holder in the x-y-$\phi$ directions in usual fashion to place the image on the screen in proper registration with a tooling fixture for the printing of the compact discs. Subsequently, a test run is made by printing the compact discs. Samples are obtained and any misregistration of colors is determined. The operator makes any further adjustments in the x-y-$\phi$ directions deemed necessary, and another test run is made. Samples are again obtained and checked for color-to-color registration. When the operator is satisfied that the registration specifications are met, the print run is begun. During operation, the apparatus of the invention maintains accurate registration of color overlay by automatically adjusting the location of the screen frame holder of a print head relative to the x-axis of the tooling fixture next to be indexed to it.

Although the invention has been particularly described with regard to moving the screen frame holder via moving the mounting means for the screen frame holder, those skilled in the art will readily appreciate that the same result can be attained, though somewhat less preferred, by moving the entire print head, instead, along the x-axis. Thus, the print head can be mounted on a slide provided on the support member, the movement of the slide being controlled by, e.g., a stepper motor, so as to be moveable along the x-axis of the tooling fixture. In this case, the micro controller will send a signal to a controller for the stepper motor that causes rotation of a screw and movement of the print head in the appropriate direction, and the amount required.

Further, although the invention has been more particularly disclosed by using a stepper motor to turn the screw member of the mounting means for the screen frame holder, those skilled in the art will fully realize that the invention is not so limited. Instead of a stepper motor, a servo motor could be used to accomplish the same function, or for that matter, any rotary device that has a feed back control loop.

As will be understood by those skilled in the applicable arts, various modifications and changes can be made in the invention and its particular form and construction without departing from the spirit and scope thereof. The embodiments disclosed herein are merely exemplary of the various modifications that the invention can take and the preferred practice thereof. it is not, however, desired to confine the invention to the exact construction and features shown and described herein, but it is desired to include all such as are properly within the scope and spirit of the invention disclosed and claimed.

What we claim is:

1. Apparatus adapted to be mounted to the print head of a silk screen printing machine comprising a plurality of print heads for maintaining the accurate registration of one color-to-another in a multicolor silk screen printing process comprising in combination:

(a) an elongated body member of a predetermined length defined by a first end and a second end, an elongated, tubular-shaped opening being provided in said elongated body member, said elongated, tubular-shaped opening extending from said first end to said second end of said elongated body member, and an internal thread pattern being provided in said tubular-shaped opening;

(b) an elongated, cylindrical-shaped screw of a predetermined length greater than that of said elongated body member defined by a first end and a second end, an external thread pattern being provided on said elongated, cylindrical-shaped screw between said first and second ends complementary to the internal thread pattern provided in said elongated tubular-shaped opening;

(c) means for automatically rotating said elongated, cylindrical-shaped screw being provided at one of said first and second ends of the elongated, cylindrical-shaped screw;

(d) means for mechanically rotating said elongated cylindrical-shaped screw being provided at the other one of said first and second ends of the elongated cylindrical-shaped screw;

(e) means connected to said elongated, cylindrical-shaped screw for mounting a screen frame holder to said elongated, cylindrical-shaped screw; and (f) means connected to said elongated body member for fixedly mounting said elongated body member to one of said plurality of print heads of the silk screen printing machine whereby, on rotation of the elongated, cylindrical-shaped screw, the means connected to said elongated, cylindrical-shaped screw for mounting a screen frame holder is caused to move the screen frame holder in a linear direction.

2. Apparatus according to claim 1 wherein the means for automatically rotating said elongated, cylindrical-shaped screw comprises a stepper motor.

3. Apparatus according to claim 2 wherein the means for automatically rotating said elongated, cylindrical-shaped screw further comprises means for automatically controlling the rotation of said stepper motor to provide a predetermined limited movement of a screen frame holder in said linear direction.

4. Apparatus according to claim 1 wherein said means for automatically rotating said elongated cylindrical-shaped screw comprises means for controlling the rotation of said elongated cylindrical-shaped screw an amount sufficient to provide a predetermined linear movement of said screen frame holder.

5. A silk screen printing machine for use in a multicolor silk-screen printing process for the printing of a plurality of flat piece parts, each of said plurality of piece parts being printed with an overlay of a plurality of different colors within a desired registration of one color-to-another, said silk screen printing machine comprising:

(a) a rotatable, indexing, horizontally disposed, transport member defined by a circular-shaped perimeter for transporting a plurality of flat piece parts each in turn in a circular-defined path to each of a plurality of silk screen print heads, a top horizontally disposed surface being provided on said horizontally disposed transport member, a plurality of spaced-apart tooling fixtures each for holding one of said plurality of flat piece parts being provided on said top horizontally disposed surface, a center point being defined by each of said plurality of tooling fixtures, x-, y-axes defining said center point, said y-axis being located on a radius of said transport member passing through said center point and said x-axis passing through said center point and being in perpendicular disposition to said y-axis;

(b) means for supporting a plurality of silk screen print heads being provided in a horizontally disposed plane above the top horizontally disposed surface of said rotatable, indexing, horizontally disposed, transport member;

(c) a plurality of silk screen print heads each for the printing of one of said plurality of different colors on each of said plurality of flat piece parts being provided on said means for supporting said plurality of silk screen print heads in predetermined fixed locations;

(d) a plurality of screen frame holders equal in number to the plurality of silk screen print heads being provided, each of said plurality of screen frame holders being mounted to one of said plurality of silk screen print heads;

(e) means for mounting each of said plurality of screen frame holders to one of said plurality of silk screen print heads whereby each said screen frame holder is movable in the direction of said x-axis of a tooling fixture provided on said rotatable, indexing, horizontally disposed, transport member; and (f) means provided in operative combination with said means for mounting said one of said plurality of screen frame holders to each of said plurality of silk screen print heads for causing said one of said plurality of screen frame holders to be moved automatically and lineraly in the x-axis of a tooling fixture during operation of said silk screen printing machine.

6. A silk screen printing machine according to claim 5 wherein the means for mounting said one of said screen frame holders to each of said plurality of silk screen print heads for causing said one of said screen frame holders to be moved in the x-axis of a tooling fixture comprises an elongated horizontally disposed body member fixedly attached to one of said plurality of silk screen print heads, an elongated tubular-shaped opening being provided in said elongated horizontally disposed body member, an elongated tubular-shaped peripheral surface being defined by said elongated tubular-shaped opening, and an internal thread pattern being provided in said elongated tubular-shaped peripheral surface, an elongated cylindrical-shaped member having a length greater than that of the elongated horizontally disposed body member being fixedly attached to each one of said plurality of screen frame holders, said elongated cylindrical-shaped member being defined by a first end and a second end, an external thread pattern being provided on said elongated cylindrical-shaped member, said elongated cylindrical shaped member being of a lesser diameter than that of the elongated cylindrical-shaped opening and being located in said elongated cylindrical-shaped opening, said internal and external thread patterns being in operative engagement with one another whereby rotation of said elongated cylindrical-shaped member provides linear movement of said screen frame holder.

7. A silk screen printing machine according to claim 6 wherein said means provided in operative combination with said means for mounting each of said plurality of screen frame holders to one of said plurality of silk screen print heads comprises means connected to one of said first and second ends of said elongated cylindrical-shaped member for causing rotation of said elongated cylindrical-shaped member.

8. A silk screen printing machine according to claim 7 wherein said means for causing rotation of said elongated cylindrical-shaped member is a stepper motor.

9. A silk screen printing machine according to claim 8 wherein said stepper motor is characterized by its capability of providing 1600 steps per revolution.

10. A silk screen printing machine according to claim 8 wherein said internal and external thread patterns provide a lead of 0.1 inch/rev. whereby each step of the stepper motor will cause a screen frame holder to be moved in a linear direction $6.25^{-5}$ inches.

11. A method for maintaining the accuracy of registration of one color-to-another in a multicolor silk screen printing process for printing a plurality of compact discs where the compact discs are each indexed, in turn, by a rotatable, annular-shaped, indexing transport member to each of a plurality of print heads where a different color of ink is applied to a surface of each of said plurality of compact discs, said method comprising:

(a) providing a rotatable, annular-shaped, indexing transport member for transporting a plurality of compact discs each in turn to one of a plurality of printing heads to be printed, a horizontally disposed top planar surface being provided on said rotatable, annular-shaped, indexing transport member, a plurality of tooling fixtures each for holding one of said plurality of compact discs being provided on and fixedly attached to the top planar surface of said rotatable, annular-shaped, indexing transport member, a centerpoint being defined by each of said plurality of tooling fixtures, x-, y-axes defining said centerpoint;

(b) providing a horizontally disposed support member above the top planar surface of said rotatable, annular-shaped, indexing transport member, a plurality of silk-screen print heads being provided each in a fixed location on said horizontally disposed support member, means for mounting a screen frame holder being mounted to each of said plurality of print heads whereby the location of said screen frame holder is adjusted in a linear direction along said x-axis of said tooling fixture, and a screen frame holder being mounted to each of said plurality of silk screen print heads;

(c) indexing each of said plurality of tooling fixtures in turn to each of said plurality of print heads for the printing of the surface of each of said plurality of compact discs located in said plurality of tooling fixtures; and (d) automatically adjusting the position location of a screen frame holder mounted to each of said plurality of print heads linearly along the x-axis of each of said plurality of tooling fixtures to a predetermined position location prior to printing each of said compact discs.

12. A silk screen printing process for the multicolor printing of a plurality of compact discs wherein the inaccuracies in print-to-print/color-to-color registration due to the inaccuracies in indexing of an annular-shaped, rotatable, indexing transport member being indexed from one print head to another in a circular-defined path of travel are corrected for, said process comprising:

(a) providing an annular-shaped, rotatable, indexing transport member, a top horizontally disposed planar surface being provided on said indexing transport member, a plurality of spaced-apart tooling fixtures being fixedly located on said top horizontally disposed surface each for the holding of a compact disc to be printed, a centerpoint being defined by each of said plurality of spaced-apart tooling fixtures, x-, y-axes defining said centerpoint of each of said plurality of tooling fixtures;

(b) providing a horizontally disposed support member in a plane above said top horizontally disposed planar surface of said indexing transport member;

(c) providing a plurality of print heads each in a predetermined spaced apart fixed location on said horizontally disposed support member each for the printing of a decoration of a different color of ink on each of said plurality of compact discs, (d) providing a plurality of screen frame holders, one for each of said plurality of print heads;

(e) providing means for mounting each of said plurality of screen frame holders to each of said plurality of print heads, each of said plurality of screen frame holders extending outwardly and overlying the plurality of tooling fixtures provided on said annular-shaped, rotatable, indexing transport member;

(f) providing means in combination with said means for mounting of each of said screen frame holders for causing movement of said screen frame holder in a linear direction relative to the x-axis of said tooling fixture;

(g) loading a compact disc in each of said plurality of tooling fixtures;

(h) indexing each of said plurality of tooling fixtures to each of said plurality of print heads for the printing of each of the plurality of compact discs with a decoration of a different color;

(i) causing each of said screen frame holders mounted to each of said plurality of print heads to be automatically moved in a linear direction relative to the x-axis of a tooling fixture a predetermined amount, at each of said plurality of print heads, to correct for the inaccuracies in indexing of said annular-shaped, rotatable, indexing transport member.

13. A method according to claim 12 wherein the automatic movement of the screen frame holder mounted to a print head is made in anticipation of a tooling fixture being indexed to that print head.

14. A method for correcting for the inaccuracies in indexing of a cam driven indexing annular-shaped transport member of a silk screen printing machine for the multicolor printing of a plurality of compact discs comprising:

(a) providing a cam driven indexing rotatable transport member, said cam driven indexing rotatable transport member being of annular-shape and being defined by a center point and an inner and outer radius, a top planar surface being provided on said indexing rotatable transport member, and a plurality of tooling fixtures each for holding a compact disc being fixedly attached to the top planar surface of the cam driven indexing rotatable transport member, a center hole defining the centerpoint of each of said plurality of tooling fixtures, said centerpoint being the 0,0 point of x-, y-axes, said y-axis lying on a radius of said cam driven indexing rotatable annular-shaped transport member, and said x-axis being in perpendicular disposition to said y-axis;

(b) providing a plurality of print heads each in a fixed location on a horizontally disposed support member being located in a plane above the top planar surface of said cam driven indexing rotatable transport member;

(c) providing a screen frame holder for each of said plurality of print heads, a silk screen comprising a screen frame and a screen having a decoration on the screen to be printed on a compact disc being provided in each screen frame holder;

(d) providing means for mounting each of said screen frame holders to each of said plurality of print heads whereby each of said screen frame holders is movable in the x-axis of a tooling fixture, said mounting means comprising a horizontally disposed elongated member, an elongated tubular-shaped opening being provided in said elongated member, and an internal thread pattern being provided in said elongated tubular-shaped opening, said horizontally disposed elongated member being fixedly mounted to a print head, an elongated cylindrical-shaped member being provided of a length greater than that of the horizontally disposed elongated member, a first and second end being defined by said elongated cylindrical-shaped member, an external thread pattern being provided on said elongated cylindrical-shaped member complementary to said internal thread pattern, said elongated cylindrical-shaped member being located in and rotatable in said elongated tubular-shaped opening;

(e) providing means on at least one of said first and second ends of said elongated cylindrical-shaped member for causing rotation of said elongated cylindrical-shaped member automatically and providing means on the other of said first and second ends for manual rotation of said elongated cylindrical-shaped member;

(f) providing means connected to said elongated cylindrical-shaped member for mounting said screen frame holder to said elongated cylindrical-shaped member whereby on rotation of said elongated cylindrical-shaped member the screen frame holder is moved in the x-axis;

(g) loading a compact disc in each of said plurality of tooling fixtures;

(h) indexing each of said plurality of tooling fixtures to each of said plurality of print heads for printing a decoration on a compact disc located in a tooling fixture;

(i) providing means to cause the elongated cylindrical-shaped member mounted to a print head to be rotated whereby the screen frame holder mounted to the elongated cylindrical-shaped member is caused to move in a linear direction in the direction of the x-axis of said tooling fixture(;)

(k) providing means to cause the elongated cylindrical-shaped member to be automatically rotated; and (l) automatically rotating the elongated cylindrical-shaped member to cause the screen frame holder to be moved in the x-axis to correct the inaccuracies in indexing of the transport member.

15. A method according to claim 14 wherein the means provided for causing automatic rotation of said elongated cylindrical-shaped member is a stepper motor.

16. A method according to claim 15 further comprising providing control means for causing rotation of said stepper motor a suitable number of steps to move said screen frame holder linearly a predetermined distance relative to the 0.0 point of said x-axis of said tooling fixture.

17. A method according to claim 14 further comprising first determining the inaccuracies in location of each of the plurality of tooling fixtures in the x-axis of each of said plurality of tooling fixtures relative to the screen frame holder mounted to each of the plurality of print heads relative to a first print head on being indexed to each of said plurality of print heads other than said first print head.

18. A method according to claim 17 comprising providing a data base comprising the inaccuracies in indexing determined for each tooling fixture on being indexed to each of said plurality print heads other than said first print head.

19. A method according to claim 18 comprising providing the inaccuracies in indexing of the indexing rotatable transport member determined for each of the plurality of tooling fixtures on being indexed to each of the plurality of print heads to each means for automatically causing the elongated cylindrical-shaped member to be rotated.

20. A multicolor silk screen printing machine comprising a plurality of print heads, a screen frame holder being mounted to each of said print heads, a rotatable annular-shaped, indexing transport member being located below said screen frame holders, said annular-shaped transport member being defined by a center point and radii extending outwardly from said center point, a plurality of tooling fixtures being provided on said transport member, each of said plurality of tooling fixtures being defined by an x- and y-axis, said y-axis lying on a radius of said annular-shaped transport, and said x-axis being in perpendicular disposition to said y-axis, means operatively associated with each said screen frame holder for automatically adjusting the position of each said screen holder linearly relative to the x-axis of a tooling fixture during operation of the silk screen printing machine whereby to maintain a desired registration of print-to-print overlay on a piece part being printed from one printing station-to-another in a multicolor screen printing operation.

21. A multicolor silk screen printing machine according to claim 20 wherein said means operatively associated with said screen frame holder comprises an elongated body member fixedly connected to said print head, an elongated opening being provided in said elongated body member, and an internal thread pattern being provided in said elongated opening, an elongated, rotatable screw member being located in said elongated opening and extending lengthwise in said opening, said elongated screw member being of a length longer than that of said elongated opening, an external thread pattern being provided on said elongated screw member for mating engagement with the internal thread pattern provided in said elongated opening, said elongated screw member being defined by a first end and a second end, means for automatically rotating said elongated screw being provided at one of said first and second ends and means for manually rotating said elongated screw member being provided at the other of said first and second ends and means connecting said screen frame holder to said elongated screw member whereby on rotation of said elongated screw member the screen frame holder is moved in a linear direction along said x-axis.

22. A multicolor silk screen printing machine according to claim 21 further comprising means for automatically controlling the rotation of said elongated screw member.

23. A multicolor silk screen printing machine according to claim 22 wherein said means for automatically rotating said elongated screw member comprises a stepper motor operatively connected to said elongated screw member at one of said first and second ends of said elongated screw member.

24. A multicolor silk screen printing machine according to claim 23 further comprising means for providing a signal to said stepper motor to cause said stepper motor to rotate a sufficient number of steps whereby to rotate said elongated screw member automatically to provide a desired linear movement of said screen frame holder in the x-axis of the tooling fixture.

25. A multicolor silk screen printing machine according to claim 24 wherein the stepper motor is capable of 1600 steps/rev. and the elongated screw member is of a diameter that a one step revolution of the stepper motor causes a linear movement of $6.25^{-5}$ inches of the screen frame holder in the x-axis of a tooling fixture.

26. A method of silk-screen printing halftones on each of a plurality of flat piece parts whereby a desired registration of print-to-print/color-to-color on the surface of a flat piece part is maintained comprising:

(a) providing an annular-shaped, rotatable, indexing transport member for transporting a plurality of flat piece parts to be silk screen printed, a plurality of tooling fixtures each for holding one of said plurality of flat piece parts being provided on said transport member, x-and y-axes defining each of said plurality of tooling fixtures, said y-axis lying on a radius of said annular-shaped rotatable transport member and said x-axis being in perpendicular disposition to said y-axis;

(b) providing a horizontally disposed support member for supporting a plurality of silk screen print heads;

(c) providing a plurality of silk screen print heads each for the printing of a decoration of a different color on a flat surface of each of said plurality of flat piece parts, each of said plurality of silk screen print heads being provided in a fixed location on said horizontally disposed support member, each of said plurality of silk screen print heads comprising a screen frame holder;

(d) providing means for mounting said screen frame holder to each of said plurality of silk screen print heads so as to be movable in the direction of the x-axis of the x-, y-axes of said tooling fixture for a flat piece part to be printed;

(e) providing means in operative combination with said means for mounting a screen frame holder to each of said plurality of print heads for causing movement of said screen frame holder in a linear direction relative to the x-axis of said tooling fixture; and (f) automatically causing said screen frame holder mounted to each of said plurality of print heads to be moved on indexing of said indexing transport member to each of said plurality of silk screen print heads, as needed, in a linear direction in the x-axis of said tooling fixture a predetermined amount to maintain said desired registration.

27. A multicolor silk screen printing machine comprising a plurality of print heads, a screen frame holder being mounted to each of said print heads, a rotatable annular-shaped, indexing transport member being located below said screen frame holders, said annular-shaped transport member being defined by a center point and radii extending outwardly from said center point, a plurality of tooling fixtures being provided on said transport member, each of said plurality of tooling fixtures being defined by an x- and y-axis, said y-axis lying on a radius of said annular-shaped transport, and said x-axis being in perpendicular disposition to said y-axis, the improvement comprising means operatively associated with each said screen frame holder for automatically adjusting the position of each said screen holder linearly relative to the x-axis of a tooling fixture during operation of the silk screen printing machine whereby to maintain a desired registration of print-to-print overlay on a piece part being printed from one printing station-to-another in a multicolor screen printing operation.

28. A method for increasing the accuracy of registration of one color-to-another in a multicolor silk screen printing process for printing a plurality of piece parts comprising:

(a) providing a rotatable, indexing transport member for transporting a plurality of piece parts each in turn to one of a plurality of printing stations, a horizontally disposed top planar surface being provided on said rotatable, indexing transport member, a plurality of tooling fixtures each for holding one of a plurality of piece parts being provided on said top planar surface, a center point being defined by each of said plurality of tooling fixtures, x-, y-axes being defined by said center point;

(b) supporting a silk screen print head at each of said plurality of printing stations in a horizontally disposed plane above said top planar surface of said rotatable, indexing transport member, a screen frame holder being mounted to each said print head, means mounting said screen frame holder to said silk screen print head for adjusting said screen frame holder in a linear direction along said x-axis of each said plurality of tooling fixtures, one of said silk screen print heads being identified as print head #1;

(c) determining the offset error for each said tooling fixture on being indexed by said, rotatable, indexing transport member to each said print head, relative to print head #1;

(d) manually adjusting said screen frame holder on each said print head prior to the start of a print run to provide said screen frame holder in the location on said x-axis whereby the registration of one-color-to-another to be printed on each said plurality of piece parts is within a desired specification;

(e) loading one of said plurality of piece parts into each of said plurality of tooling fixtures to begin a print run;

(f) indexing each of said plurality of tooling fixtures in turn to each said print head for the printing of the surface of each of said plurality of piece parts; and (g) automatically adjusting the location of each said screen frame holder linearly along the x-axis of each said plurality of tooling fixtures a predetermined distance prior to printing each said plurality of piece parts whereby to maintain said registration of one-color-to-another.

29. A multicolor silk screen printing process for printing a plurality of piece parts wherein a desired registration of one-color-to-another is maintained comprising:

(a) providing a rotatable indexing transport member for transporting a plurality of piece parts each in turn to one of a plurality of printing stations, a horizontally disposed top planar surface being provided on said indexing transport member, a center point being defined by said transport member and radii extending outwardly from said center point, a plurality of tooling fixtures each for holding one of a plurality of piece parts being provided on said top planar surface, a center point being defined by each of said plurality of tooling fixtures, x-, y-axes being defined by said center point, said y-axis of each said plurality of tooling fixtures lying on one of said radii extending outwardly from the center point of said transport member and said x-axis of each said tooling fixture being in perpendicular disposition to said y-axis;

(b) supporting a silk screen print head at each of said plurality of printing stations in a horizontally disposed plane above said top planar surface of said rotatable, indexing transport member, a screen frame holder being mounted to each said print head, means mounting said screen frame holder to said silk screen print head for adjusting said screen frame holder manually and automatically in a linear direction along said x-axis of each said plurality of tooling fixtures;

(c) placing a silk screen in each said screen frame holder;

(d) manually adjusting each said screen frame holder on each said print head to provide that registration of one-color-to-another to be printed on each of a plurality of piece parts is within a desired specification;

(e) loading one of a plurality of piece parts into each of said plurality of tooling fixtures to begin a print run;

(f) indexing each of said plurality of tooling fixtures in turn to each said print head for the printing of each of said plurality of piece parts; and (g) automatically adjusting the location of each said screen frame holder linearly along the x-axis of each said plurality of tooling fixtures a predetermined distance prior to printing each said plurality of piece parts whereby to maintain said registration of one-color-to-another.

* * * * *